US007428785B2

(12) United States Patent
Kim

(10) Patent No.: US 7,428,785 B2
(45) Date of Patent: Sep. 30, 2008

(54) HAIR DRYER

(76) Inventor: Tai Cheul Kim, 29 Geumho-dong 1-ga, Seongdong-gu, Seoul 133-800 (KR)

( * ) Notice: Subject to any disclaimer, the term of this patent is extended or adjusted under 35 U.S.C. 154(b) by 209 days.

(21) Appl. No.: 11/244,708

(22) Filed: Oct. 6, 2005

(65) Prior Publication Data

US 2006/0112586 A1 Jun. 1, 2006

(30) Foreign Application Priority Data

Nov. 30, 2004 (KR) ..... 10-2004-0099269
Mar. 4, 2005 (KR) ..... 10-2005-0018139
Apr. 29, 2005 (KR) ..... 10-2005-0036033

(51) Int. Cl.
*F26B 3/34* (2006.01)
*A45D 20/12* (2006.01)

(52) U.S. Cl. ..... 34/96; 34/266; 34/82; 219/222; 392/384; 392/385

(58) Field of Classification Search ..... 34/96–99, 34/266, 82; 132/212; 219/222; 392/379–385
See application file for complete search history.

(56) References Cited

U.S. PATENT DOCUMENTS 3,284,611 A * 11/1966 Laing ..... 392/384
3,903,905 A * 9/1975 Tucker ..... 132/118
3,955,065 A 5/1976 Chambon
4,287,673 A * 9/1981 Wolter ..... 34/97
4,447,840 A * 5/1984 Mignolet et al. ..... 360/137
4,629,864 A * 12/1986 Wilson ..... 392/385
4,676,260 A * 6/1987 Paulhus et al. ..... 132/212
5,058,193 A 10/1991 Appierto
5,448,677 A * 9/1995 Fell et al. ..... 392/383
6,715,215 B1 4/2004 Yeung
6,798,982 B2 * 9/2004 Ryu et al. ..... 392/385

FOREIGN PATENT DOCUMENTS

| | | |
|---|---|---|
| CN | 2610732 Y | 4/2004 |
| EP | 1070459 | 1/2001 |
| GB | 2226953 | 7/1990 |
| GB | 2331011 | 5/1999 |
| JP | 05-329020 | 12/1993 |
| JP | 08-056739 | 3/1996 |
| JP | 2004-033728 | 2/2004 |

* cited by examiner

*Primary Examiner*—Jiping Lu
(74) *Attorney, Agent, or Firm*—Pate Pierce & Baird

(57) ABSTRACT

A hair dryer in which the direction of a palm of a user gripping the hair dryer is same as the direction of wind blown from the hair dryer. A blowing pipe is coupled to a case and has an air outlet at one end. A heater for heating air is provided inside the case. A fan for blowing air toward the heater and the air outlet is provided inside the case. A grip part, which is designed to be gripped by a human hand, is coupled to a portion of the case opposite to the air outlet. A handle is mounted to the grip part so as to prevent the grip part from being released from the band.

12 Claims, 12 Drawing Sheets

HAIR DRYER

This application claims the benefit of priority under 35 U.S.C. § 119 to Korean Patent Application Nos. 10-2005-36033 filed Apr. 29, 2005, 10-2005-18139 filed Mar. 4, 2005 and 10-2004-99269 filed Nov. 30, 2004, which are incorporated herein by reference.

FIELD OF THE INVENTION

The present invention generally relates to a hair dryer, and more particularly to a hair dryer configured in a manner so that the direction of a palm of a user gripping the hair dryer is the same as the direction of wind blown from the hair dryer.

BACKGROUND OF THE INVENTION

Hair dryers are employed not only to remove moisture from hair, but also to facilitate the styling and shaping of the hair as it dries. Typically, the hair dryers are constructed to have a housing defining an air intake and an air outlet. The housing contains a fan, which is adapted to draw air from the ambient environment through the air intake, and a heating element.

Generally, the housing of a prior art hair dryer includes a handle such that the overall device has a "pistol-like" shape. Such type of hair dryer is disclosed in U.S. Pat. Nos. 6,408,533 and 6,715,215.

However, the handle is at an angle of about 90° to the air outlet in the "pistol-like" shaped hair dryer. Thus, when changing the direction of the blowing air, the user must often twist his/her wrist or change the position of his/her hand gripping the handle. Further, a relatively larger force is needed in gripping the handle. Such an inconvenience can cause much fatigue to the user's wrist when drying or styling the hair of the user.

SUMMARY OF THE INVENTION

Therefore, it is an object of the present invention to provide a hair dryer in which the direction of blowing air can be freely changed with a small movement of a user's wrist.

It is another object of the present invention to provide a hair dryer, which can reduce unnecessary electricity consumption and prevent accidents such as electric shocks by automatically shutting down the power when a user takes his/her hand off the hair dryer.

It is yet another object of the present invention to provide a hair dryer with a detachable comb member so that combing can be done while drying the hair.

It is a further object of the present invention to provide a hair dryer, which can generate far-infrared ray and anion and radiate the same while blowing the air.

It is still yet another object of the present invention to provide a hair dryer, which can prevent the leakage of electric or magnetic field generated by a motor or a heater.

Consistent with the foregoing objects and in accordance with the invention as embodied broadly herein, there is provided a hair dryer comprising: a case; a blowing pipe coupled to the case and having an air outlet at one end; a heater for heating air disposed inside the case; a fan for blowing air toward the heater and the air outlet, the fan being disposed inside the case; a grip part configured to be gripped by a human hand and coupled to a portion of the case opposite to the air outlet; and a handle mounted to the grip part to prevent the grip part from being released from the hand.

A filter is mounted to a portion of the case facing the fan. Further, a plurality of air intakes are formed at the grip part adjacent to the filter.

A space is formed at the grip part above the filter for removing extraneous substances from the filter. Further, a cover is detachably coupled to the grip part to open and close the space. The handle is installed on the cover.

The handle includes a vertical plate designed to be fitted between two fingers of the hand. It also includes a horizontal upper plate, which is formed at the top of the vertical plate to prevent the vertical plate from slipping out of the hand, and a horizontal lower plate formed at the bottom of the vertical plate. A depressed portion is formed at the cover in which the lower plate of the handle is rotatably seated.

A cylindrical holder is located below the cover and connected to the lower plate of the handle so as to be rotated together with the handle. The holder has at least one supporting plate sectioned partially from the side wall of the holder, which is to be deformed elastically from the side wall, and a latching convex formed at the inner surface of the supporting plate. A circular loop is formed at the lower surface of the cover and is surrounded by the holder. The loop has a plurality of recesses arranged radially along the overall outer periphery of the loop. When the handle is rotated, the latching convex of the supporting plate is selectively fitted in one of the recesses of the loop.

A power switch for controlling the power supplied to the hair dryer and at least one manipulating button for selecting the operating mode are provided on the case. The power switch can be pressed down through the pressure of the hand holding the grip part.

A switch-accommodating portion for accommodating the power switch is formed at the grip part. The power switch includes: a push button exposed above the grip part; a spring for biasing the push button above the grip part; an operating rod extending from the push button toward the inside of the case; and a restraining rod extending from the push button toward the inside of the switch-accommodating portion, wherein the restraining rod has a hook at one end. A means for sensing the movement of the operating rod and a control unit for controlling the operation of the hair dryer in response to the signals from the means for sensing the operating rod are provided inside the case.

A grill for preventing extraneous substances from entering into the blowing pipe is mounted at a position near the air outlet inside the blowing pipe. The grill is coated with ceramics containing tourmaline or iron oxide.

A far-infrared ray and anion generating device is mounted inside the case. The far-infrared ray and anion generating device includes: a quartz tube coated with ceramics containing tourmaline or iron oxide; a ceramic base provided in the quartz tube; and a heating coil wound around the ceramic base.

The hair dryer further comprises an auxiliary blowing unit detachably mounted to the blowing pipe near the air outlet, wherein the auxiliary blowing unit has a plurality of air holes.

BRIEF DESCRIPTION OF DRAWINGS

The above object and features of the present invention will become more apparent from the following description of the preferred embodiments given in conjunction with the accompanying drawings.

DETAILED DESCRIPTION OF THE PRESENT INVENTION

The preferred embodiments of the present invention will now be described with reference to the accompanying drawings.

Figure 1:
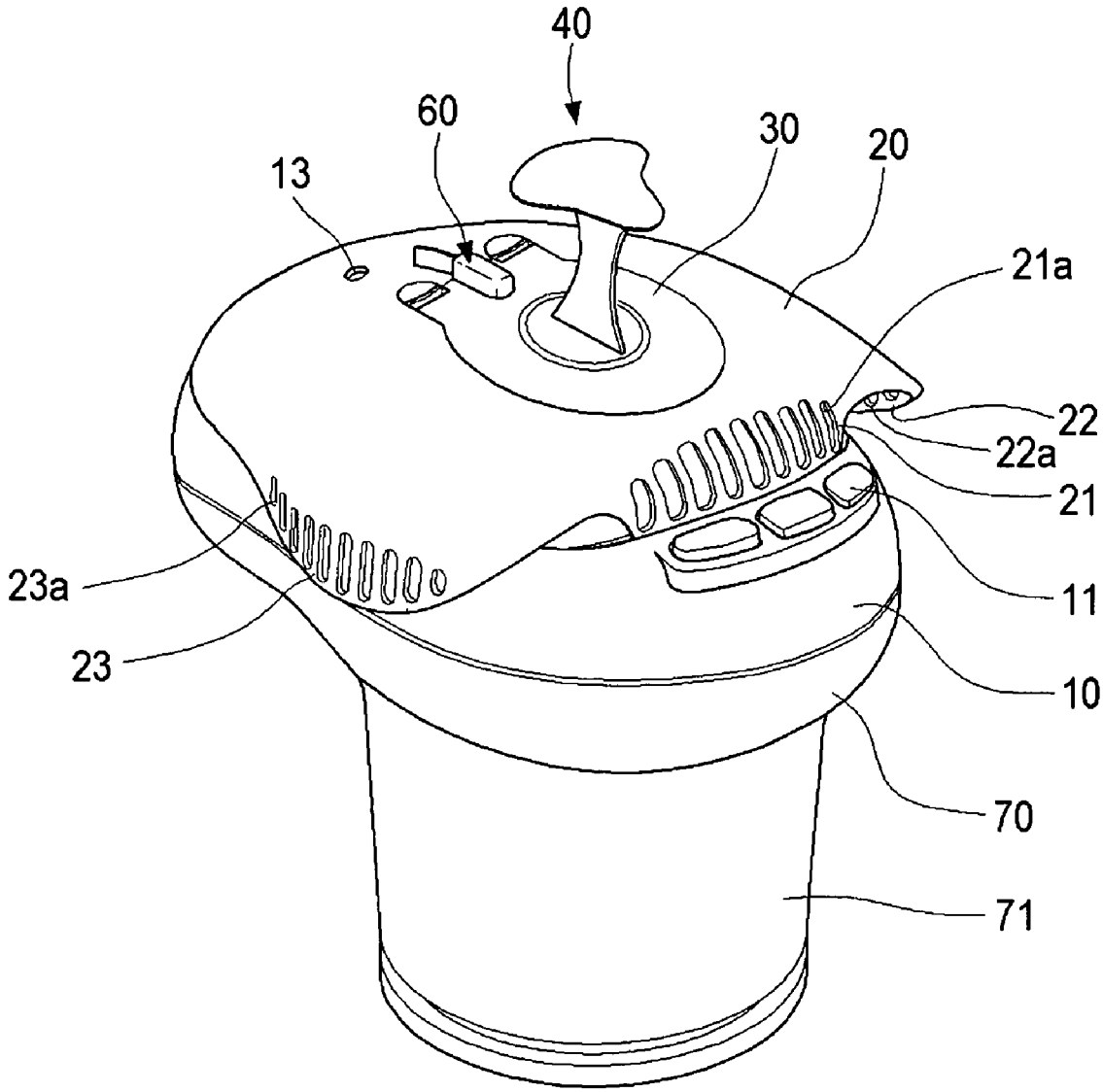
FIG. 1 is a perspective view illustrating a hair dryer constructed in accordance with the present invention.
Figure 2:
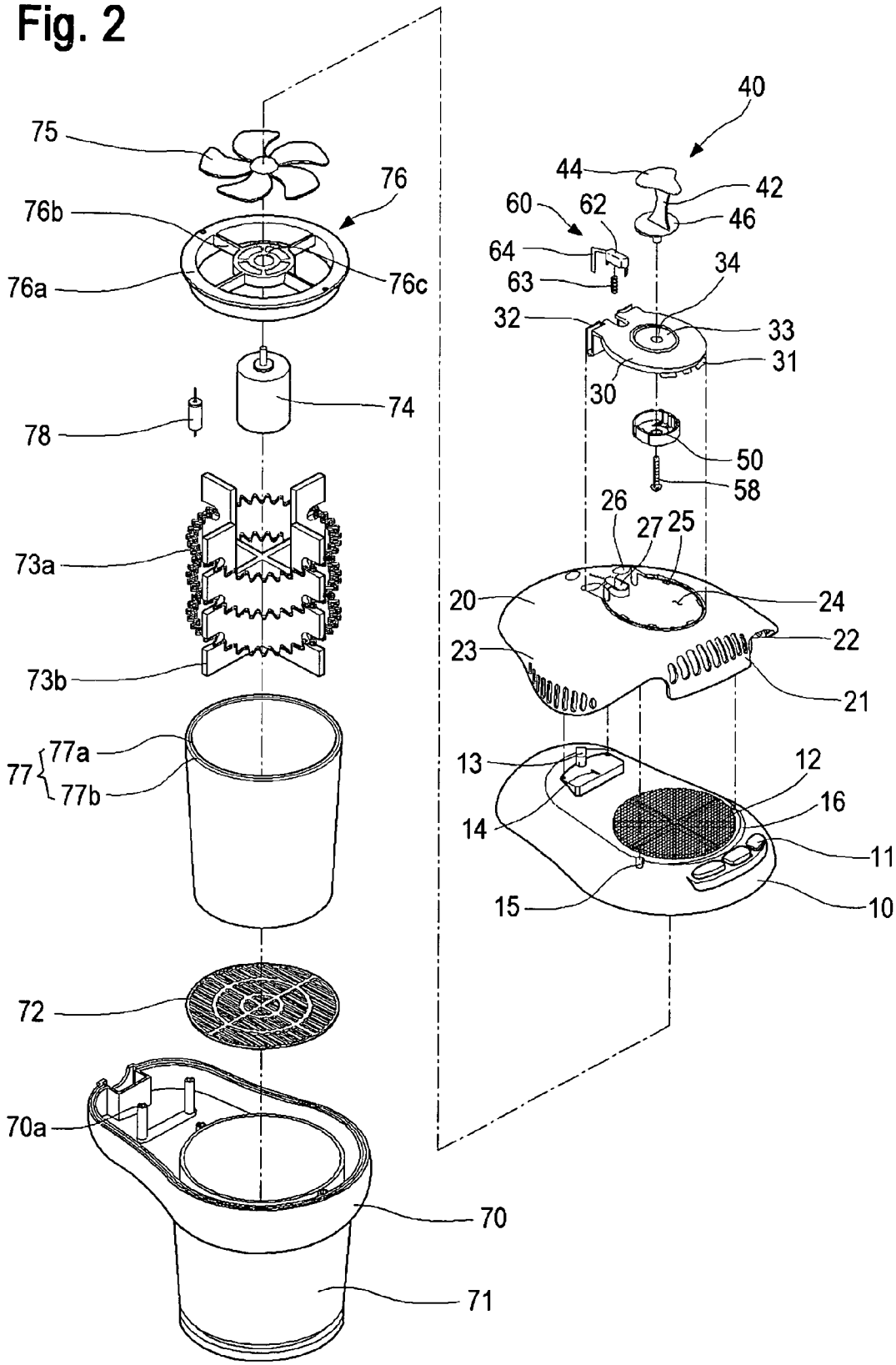
FIG. 2 is an exploded perspective view illustrating a hair dryer constructed in accordance with the present invention.

FIGS. 1 and 2 are perspective and exploded perspective views illustrating a hair dryer, which is constructed in accordance with the present invention. As shown in the figures, there is provided a case for forming an exterior appearance and containing essential components, which comprises an upper case 10 and a lower case 70. The upper case 10 and the lower case 70 are manufactured separately and coupled to each other to facilitate the production and assembly processes. Preferably, the upper and lower cases 10 and 70 are made from synthetic resins, but are certainly not limited thereto.

Manipulating buttons 11 for selecting operating modes of the hair dryer are provided at the front surface of the upper case 10. The top portions of the manipulating buttons 11 are exposed from the upper case 10 so that a user can easily push them. A filter 12, which permits an ambient air to pass while filtering extraneous substances such as dust in the air, is provided at the upper surface of the upper case 10. Preferably, the filter 12 is made from a metallic material. A lamp 13 for indicating the operating condition of the hair dryer and a slit 14 for guiding the movement of a power switch 60 are provided at the rear portion of the upper surface of the upper case 10.

A grip part 20 is fixed above the upper case 10. The grip part 20 shields most of the upper case 10 except the manipulating buttons 11. When using the hair dryer, the user holds the grip part 20 with his/her hand. The grip part 20 is configured in a dome-shape so that the user can easily hold the grip part 20 with his/her hand (i.e., a palm). In order to fix the grip part 20 to the upper case 10, protrusions (not shown) are formed at the lower surface of the grip part 20 and inserting holes 15, which correspond to the protrusions, are formed at the upper surface of the upper case 10. The protrusions of the grip part 20 are fitted into the respective inserting holes 15 of the uppercase 10.

Figure 3:
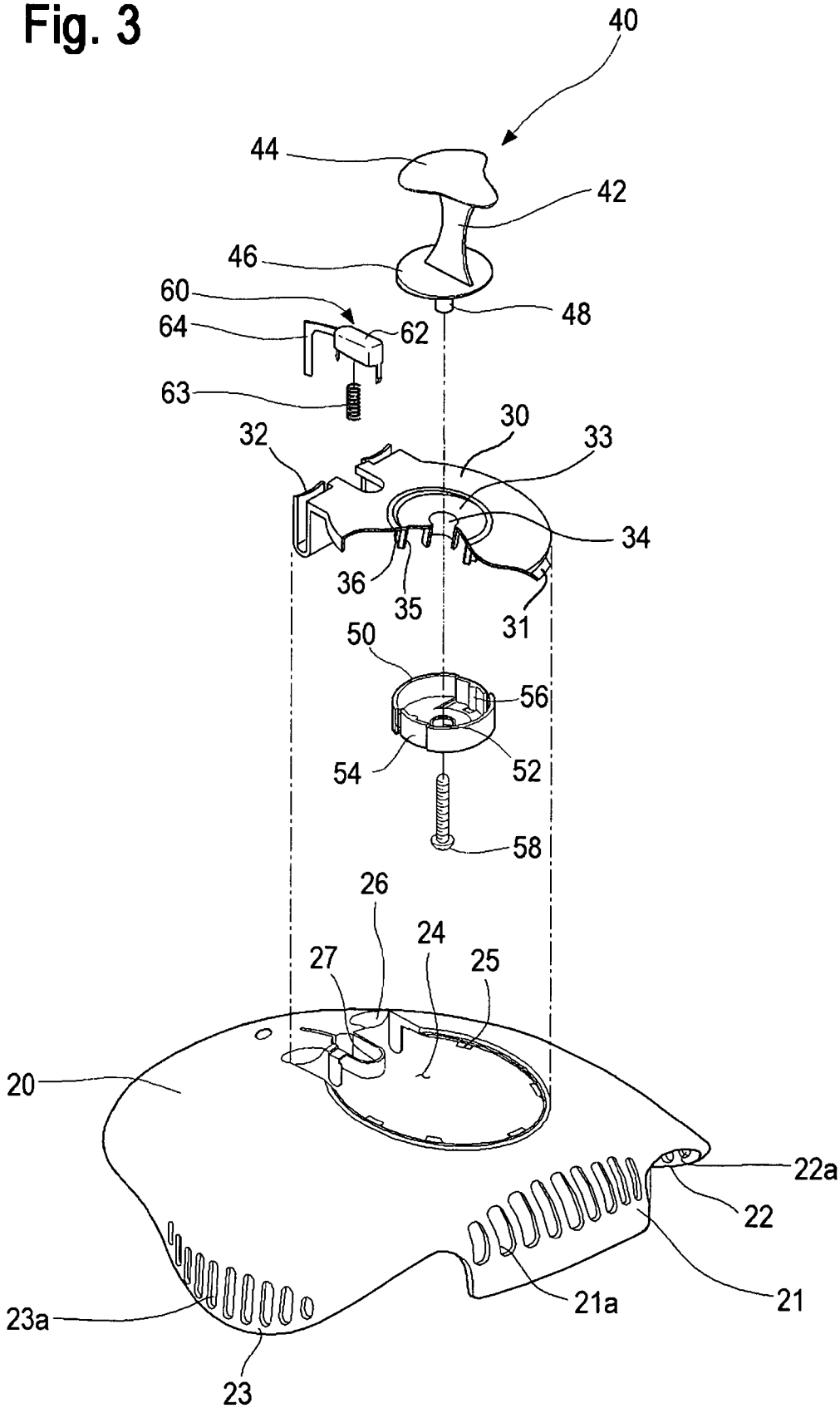
FIG. 3 is an exploded perspective view illustrating a grip part, a cover and a handle.

Wing portions 21, 22 and 23 extend downward integrally from the front and both sides of the grip part 20. As shown in FIG. 3, a plurality of air intakes 21*a*, 22*a* and 23*a* are formed at the wing portions 21, 22 and 23, respectively, through which the ambient air is introduced into the cases 10 and 70. For smooth inflow of air, the air intakes 21*a*, 22*a* and 23*a* are placed away from the upper case 10. For enhancing the stability of coupling between the grip part 20 and the upper case 10, the front end of the wing portion 21 is fitted into a slot 16, which is formed at the upper surface of the uppercase 10.

The grip part 20 is provided with a coupling space 24, through which the extraneous substances on the filter 12 can be removed. A cover 30 is detachably coupled to the grip part 20 to open or close the coupling space 24. A plurality of supporting pieces 25 is formed at the border defining the coupling space 24 to support the cover 30. Further, a plurality of inserting pieces 31 is formed at the verge of the cover 30. To securely couple the cover 30 to the grip part 20, a pair of hooks 32 are provided at the rear portion of the cover 30. Each hook 32 is formed in a U-shape and has elasticity. A pair of inserting holes 26, into which the corresponding hooks 32 are elastically fitted, are formed at the grip part 20.

After locating the inserting pieces 31 of the cover 30 into the gaps between the adjacent supporting pieces 25 in the coupling space 24, if the rear portion of the cover 30 is pushed down, the inserting pieces 31 of the cover 30 are forced under the grip part 20. At the same time, the hooks 32 of the cover 30 are forcedly fitted into the inserting holes 26 of the grip part 20 against the elastic force of the hooks 32. When separating the cover 30 from the grip part 20, if the hooks 32 are pressed and lifted up, the hooks 32 and the inserting pieces 31 are released from the inserting holes 26 and the supporting pieces 25 and thus, the coupling space 24 is opened. Accordingly, the filter 12 can be easily cleaned by clearing the extraneous substances such as dust, hair and the like from the filter 12 through the opened coupling space 24.

A handle 40 is mounted to the cover 30. The handle 40 can prevent the grip part 20 from slipping out of the user's hand. The handle 40 includes a vertical plate 42, a horizontal upper plate 44 formed at the top of the vertical plate 42, and a horizontal lower plate 46 formed at the bottom of the vertical plate 42. The vertical plate 42 is to be fitted between two fingers of the user. The horizontal upper plate 44 prevents the vertical plate 42 from slipping out of the user's hand. These plates 42, 44 and 46 may be formed in a unitary body having an I-shaped cross-section. When considering the change in thickness of the finger, it is preferable that the upper plate 44 is tilted down as it goes onward. A cylindrical coupling protrusion 48 is formed vertically at the lower surface of the lower plate 46. A screw hole (not shown) is formed at the coupling protrusion 48 in a longitudinal direction.

A depressed portion 33 is formed at the upper surface of the cover 30, in which the lower plate 46 of the handle 40 is seated. A through-hole 34 is formed at the center of the depressed portion 33, through which the coupling protrusion 48 of the handle 40 passes. A circular loop 35 is formed around the through-hole 34 at the lower surface of the cover 30. A plurality of recesses 36 is formed in a vertical direction at the outer surface of the loop 35. The recesses 36 are arranged radially along the overall outer periphery of the loop 35.

A holder 50 is located below the cover 30 while surrounding the loop 35. The holder 50 is shaped in a hollow cylinder having an opened top and a closed bottom. A through-hole 52, for passing a screw 58 therethrough, is formed at the center of the bottom plate of the holder 50. The screw 58 passes through the through-hole 52 of the holder 50 and is tightened into the screw-hole of the coupling protrusion 48 of the handle 40. Accordingly, the handle 40, the cover 30 and the holder 50 are assembled together.

Two supporting plates 54 are formed integrally at the side wall of the holder 50. The supporting plates 54 are opposed to each other. Each supporting plate 54 is partially sectioned from the side wall of the holder 50 so that the supporting plate 54 can be deformed elastically from the side wall of the holder 50. A latching convex 56 is formed at the inner surface of each supporting plate 54. The latching convex 56 extends vertically so as to be fitted in one of the recesses 36 of the loop 35. If the user rotates the handle 40 relative to the cover 30, the holder 50 fixed to the handle 40 by the screw 58 also rotates together with the handle 40. In such a case, the supporting plates 54 formed at the holder 50 are elastically deformed because of the loop 35. Then, the latching convex 56 of each supporting plate 54 is selectively fitted into one of the recesses 36 of the loop 35. Therefore, only when the rotating force is applied to the handle 40, which is more than a predetermined force, the supporting plate 54 of the holder 50 is deformed elastically, and the latching convex 56 gets out of the present-fitted recess 36 and is selectively fitted into the other recess 36. By such structural feature, the user can freely rotate the handle 40 to any direction and put the handle 40 between the fingers in a convenient position so as to hold the hair dryer according to the user's desire when drying or styling the hair.

Figure 5:
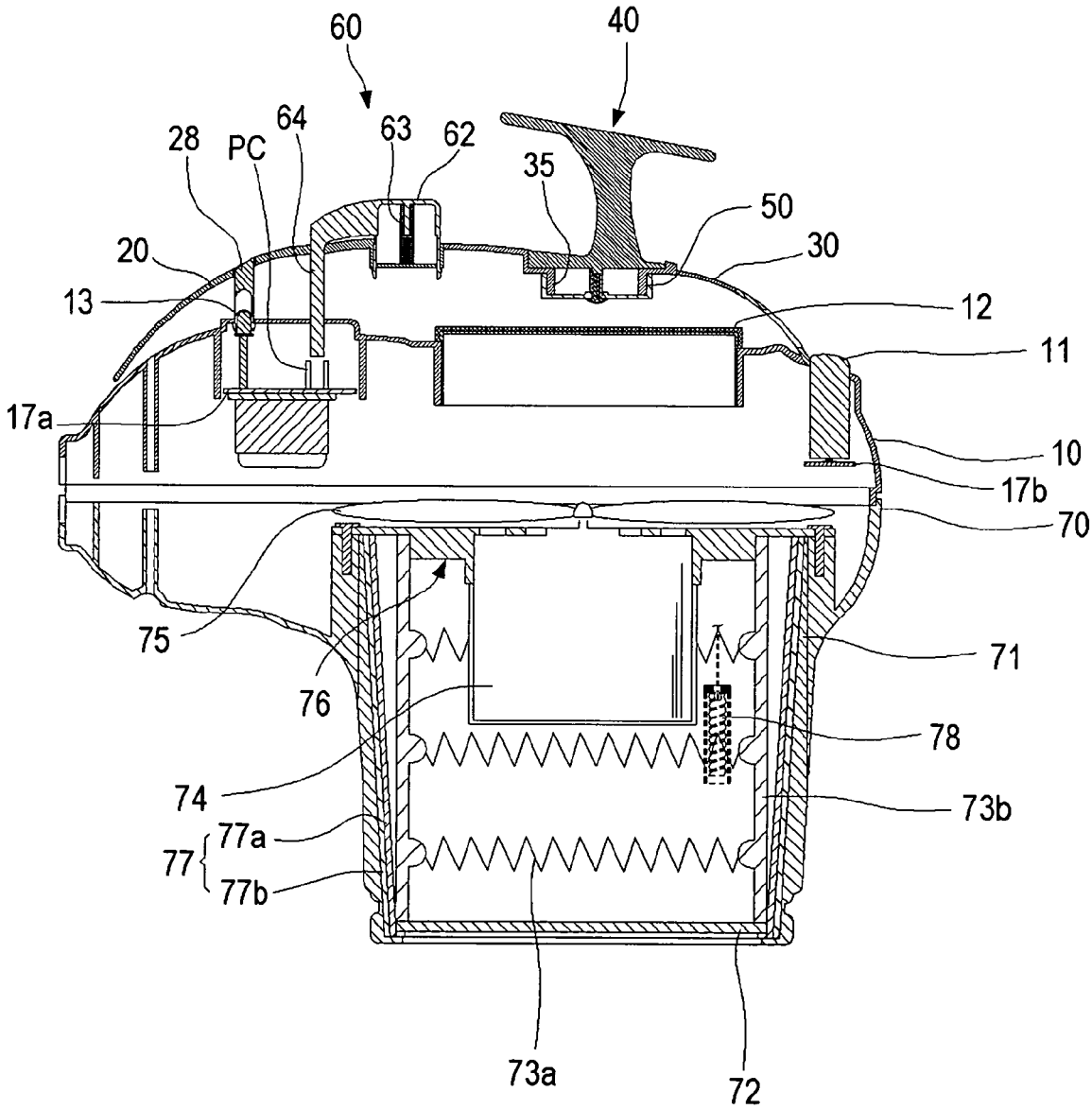
FIG. 5 is a cross-sectional view of a hair dryer constructed in accordance with the present invention.
Figure 6:
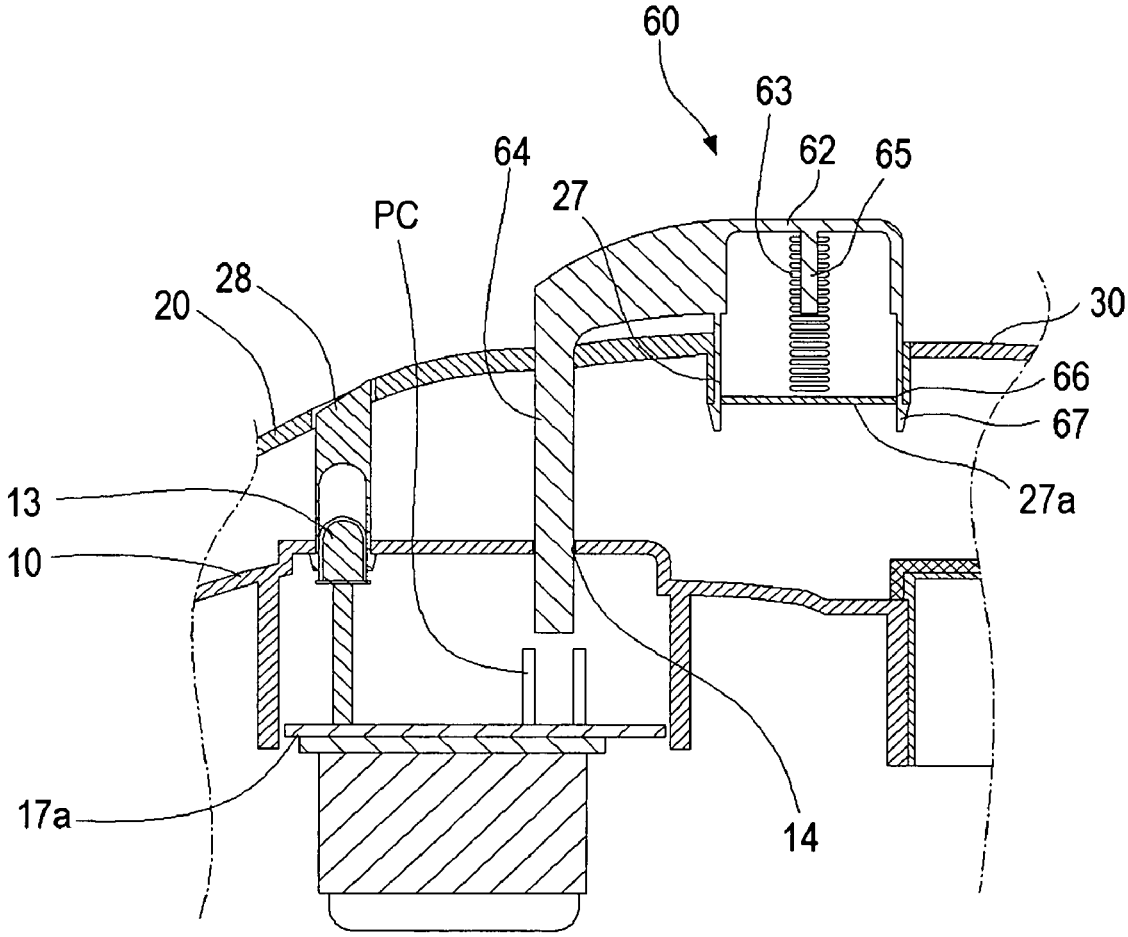
FIG. 6 is an enlarged cross-sectional view of a mounting structure of an operation switch and a lamp.

A power switch 60 for controlling the power supplied to the hair dryer is provided at the grip part 20. The power switch 60 is located at a position where the power switch 60 contacts the user's palm when putting the handle 40 between the fingers and holding the grip part 20. As shown in FIGS. 3, 5 and 6, a switch-accommodating portion 27 is formed at the grip part 20 to accommodate the power switch 60. The power switch 60 includes: a push button 62 exposed above the grip part 20; a spring 63 located between the push button 62 and a base 27*a* of the switch-accommodating portion 27 and biasing the push button 62 above the grip part 20; and an operating rod 64 extending from the push button 62 toward the inside of the upper case 10. A protrusion 65 for supporting the spring 63 is formed at the lower surface of the push button 62. About half of the spring 63 is wound around the protrusion 65. A pair of restraining rods 66 are formed at the lower surface of the push button 62 and located in the switch-accommodating portion 27. Each restraining rod 66 has a hook 67 at its lower end. Provided at the base 27*a* of the switch-accommodating portion 27 are holes, through which the restraining rods 66 pass and progress under the base 27*a*. When the push button 62 is pressed down by the pressure of the user's palm holding the grip part 20, the spring 63 is compressed and the operating rod 64 also moves inside the upper case 10 through the slit 14.

A PCB (printed circuit board) 17*a*, on which a control unit and circuits for controlling the operation of the hair dryer are mounted, is installed inside the upper case 10. Means for sensing the movement of the operating rod 64 of the power switch 60 is installed on the PCB 17*a*. In this embodiment, the sensing means is a photo coupler PC. When the photo coupler PC senses the operating rod 64 moving downward together with the push button 62 pressed down, the control unit controls the hair dryer to operate in response to the signals from the photo coupler PC. When the force of pressing the push button 62 is removed, the operating rod 64 moves up away from the photo coupler PC and returns to its original position by the elastic restoring force of the spring 63. Accordingly, the power is automatically shut off and the operation of the hair dryer is stopped. At this time, because the hooks 67 of the restraining rods 66 are hitched by the switch-accommodating portion 27, the power switch 60 can stop exactly at its original position and is prevented from being separated from the switch-accommodating portion 27. In addition, at the inside the upper case 10, there is mounted another PCB 17*b* that is electrically connected to the manipulating buttons 11 for selecting the operating modes of the hair dryer.

The lamp 13, which is located at the rear portion of the upper case 10, is electrically connected to the PCB 17*a*. The lamp 13 interlocks with the power switch 60 and emits a light during the operation of the hair dryer. The light from the lamp 13 is radiated outside through a transparent cover 28 provided at the grip part 20, thereby indicating the operating state of the hair dryer to the user.

Figure 4:
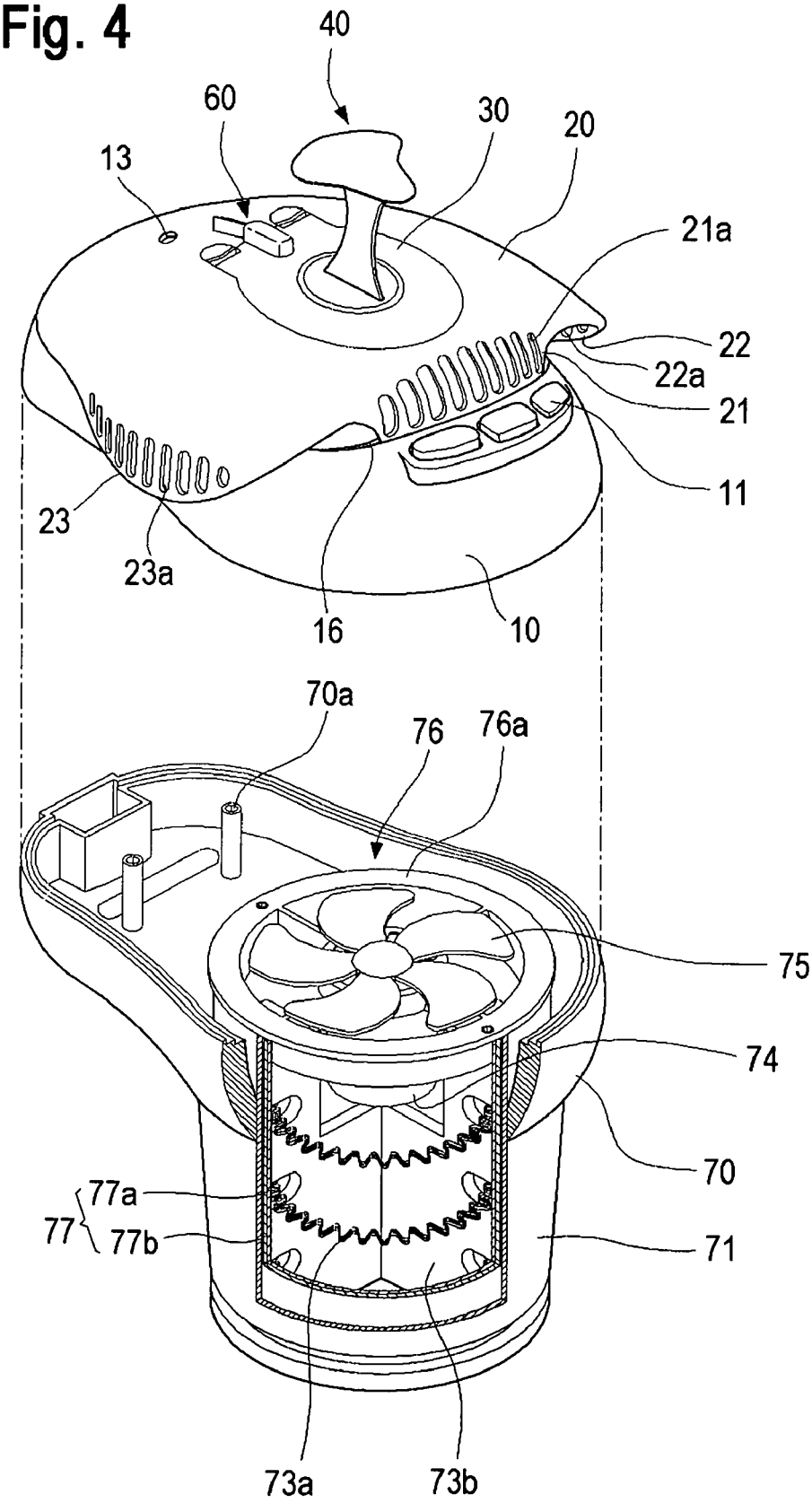
FIG. 4 is a partial exploded perspective view illustrating a hair dryer constructed in accordance with the present invention.

Referring to FIGS. 2 and 4, screw-holes 70*a* are formed at the lower case 70 for screw-coupling the lower case 70 to the upper case 10. A hollow cylindrical blowing pipe 71 is coupled to the lower case 70. The opened top of the blowing pipe 71 is faced with the filter 12 of the upper case 10. The upper end portion of the blowing pipe 71 is forcedly inserted into the lower case 70, and the remaining portion of the blowing pipe 71 extends downward outside the lower case 70. Thus, the direction of the user's palm gripping the grip part 20 is identical to the direction of wind blown from the blowing pipe 71. Preferably, the diameter of the blowing pipe 71 becomes narrower from the top to the bottom to facilitate the airflow exhausted from the air outlet of the blowing pipe 71. The blowing pipe 71 may be made from synthetic resins similar to the upper and lower cases 10 and 70, but is certainly not limited thereto.

The blowing pipe 71 provides a space in which most of the main components are installed. More specifically, a blocking grill 72 is mounted in the blowing pipe 71 near the air outlet so as to prevent extraneous substances such as dust or hair from entering into the blowing pipe 71. Preferably, the blocking grill 72 is coated with ceramics containing tourmaline or iron oxide and the like such that far-infrared ray or anion can be emitted when using the hair dryer. Above the blocking grill 72, there are provided a heater 73*a* for diffusing heat in high temperature and a coil bracket 73*b* of a heat resistant insulator. The coils of the heater 73*a* are supported by the coil bracket 73*b*. A motor 74 is located above the coil bracket 73*b*, while a fan 75 is located above the motor 74. The driving force of the motor 74 is transmitted to the fan 75 so that the fan 75 draws the ambient air into the upper and lower cases 10 and 70 and blows the air to the outside through the blowing pipe 71. Between the motor 74 and the fan 75, there is provided a supporting bracket 76 for supporting the motor 74 and the fan 75.

The supporting bracket 76 includes: a circular rim 76*a*; several arms 76*b* extending from the inner surface of the rim 76*a* toward the center of the rim 76*a*; and a boss 76*c* positioned at the center of the rim 76*a* and supported by the arms 76*b*. The rim 76*a* is fixed to the upper end of the blowing pipe 71 by screws. Spaces are provided between the arms 76*b*, through which ambient air drawn by the fan 75 can flow toward the heater 73*a*. A driving shaft of the motor 74 is coupled to the fan 75 through the boss 76*c*.

The blowing pipe 71 further contains a hollow cylindrical shielding tube 77. The shielding tube 77 accommodates the fan 75, the motor 74, the heater 73*a* and the coil bracket 73*b*. The shielding tube 77 consists of an inner layer 77*a* and an outer layer 77*b*, which is attached to the outer surface of the inner layer 77*a*. In order to prevent the lower case 70 and the blowing pipe 71 made of synthetic resins from being deformed due to the heat generated by the motor 74 and the heater 73*a*, the inner layer 77*a* of the shielding tube 77 may be made from a thermal-resistant mica material, but is certainly not limited thereto. In order to prevent the leakage of the electromagnetic waves from the motor 74 and the heater 73*a*, the outer layer 77*b* of the shielding tube 77 may be made from silicon steel material, but is certainly not limited thereto.

Figure 7:
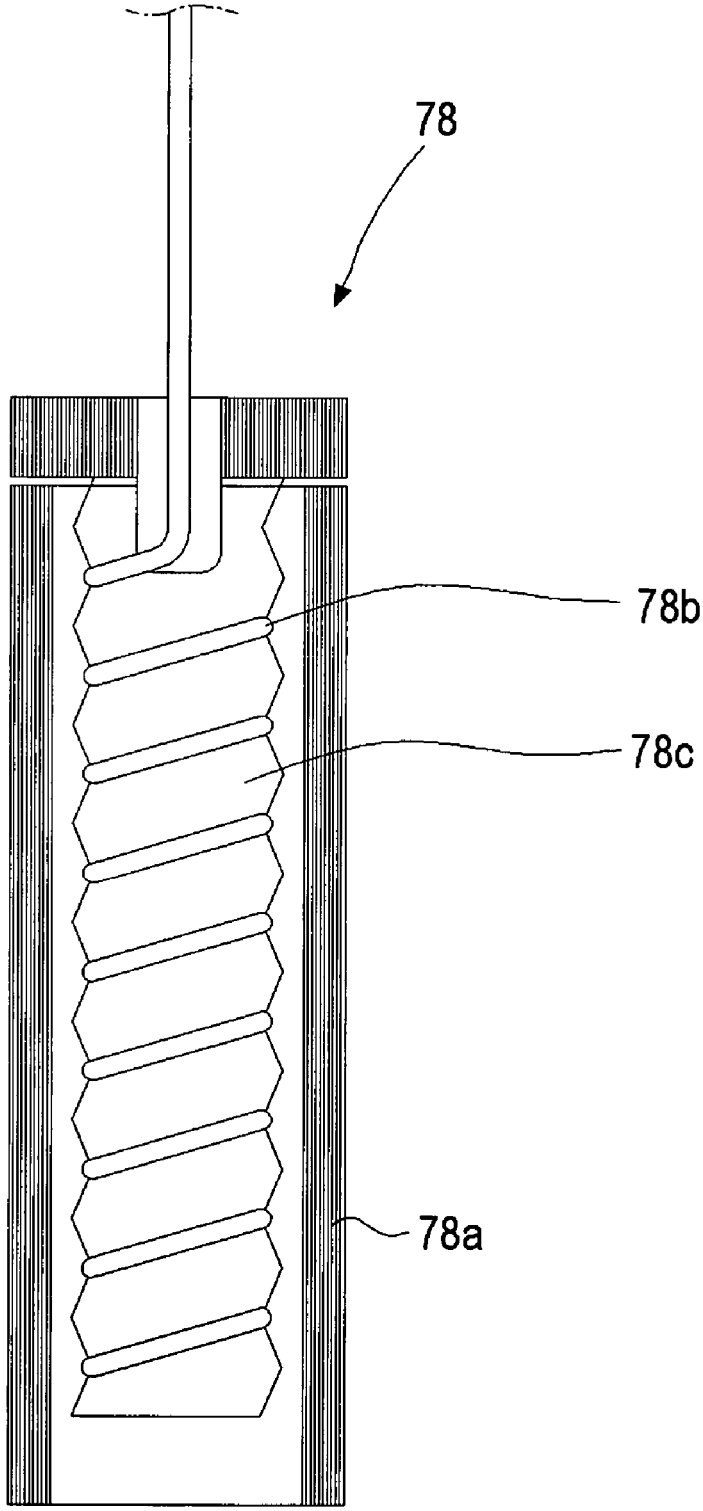
FIG. 7 is an enlarged cross-sectional view of a far-infrared ray and anion generating device.

A far-infrared ray and anion generating device 78 is mounted inside the lower case 70. As shown in FIG. 7, the far-infrared ray and anion generating device 78 includes: a quartz tube 78*a* coated with ceramics containing tourmaline or iron oxide; a ceramic base 78*c* provided in the quartz tube 78*a*; and a heating coil 78*b* wound around the ceramic base 78*c*. Preferably, the far-infrared ray and anion generating device 78 is positioned near the heater 73*a*.

Figure 8:
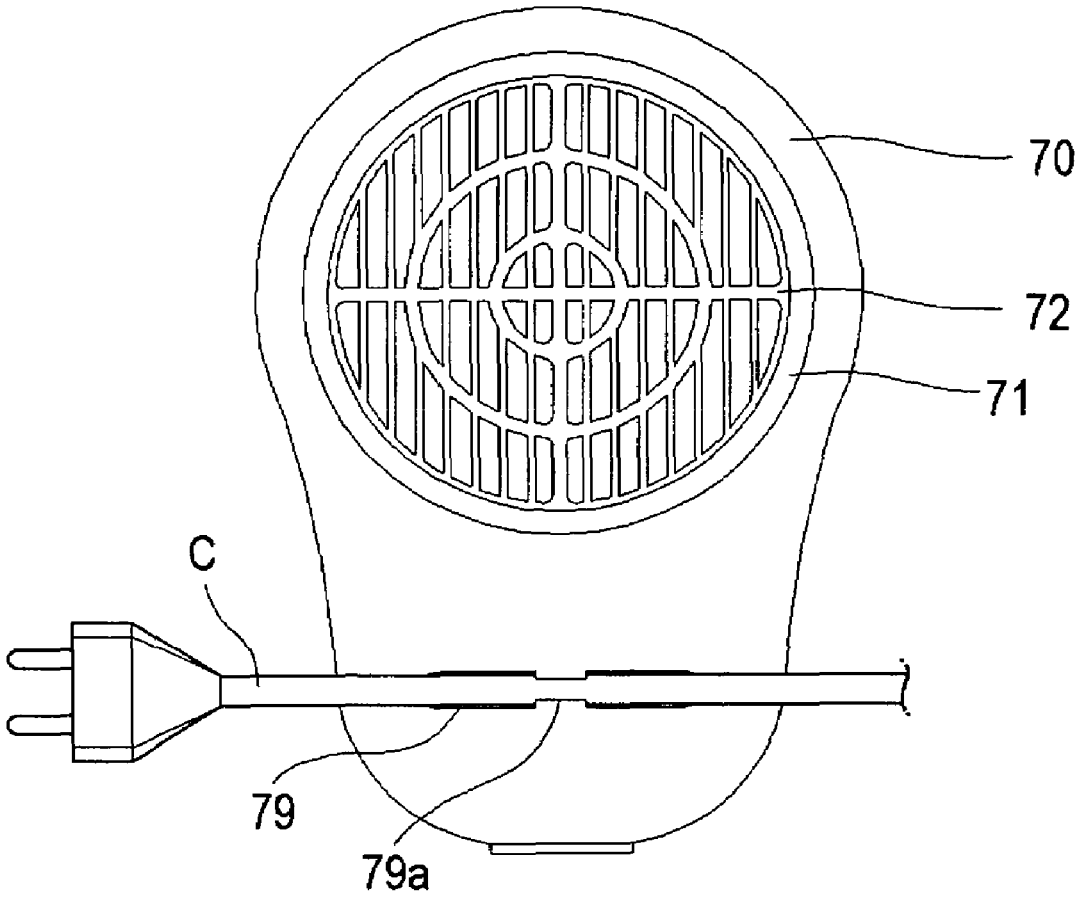
FIG. 8 is a bottom view of a hair dryer constructed in accordance with the present invention.

As shown in FIG. 8, the lower case 70 has a cable-receiving recess 79 at its lower surface. When the hair dryer is not in use, a cable C is wound around the cases 10 and 70 or the blowing pipe 71. Further, a front end portion of the cable C, which is adjacent to a plug, is fitted into the cable-receiving recess 79. To fix the cable C more securely, two opposing protrusions 79*a* are formed over the recess 79. The gap between the opposing protrusions 79*a* is slightly smaller than the thickness of the cable C.

Figure 9:
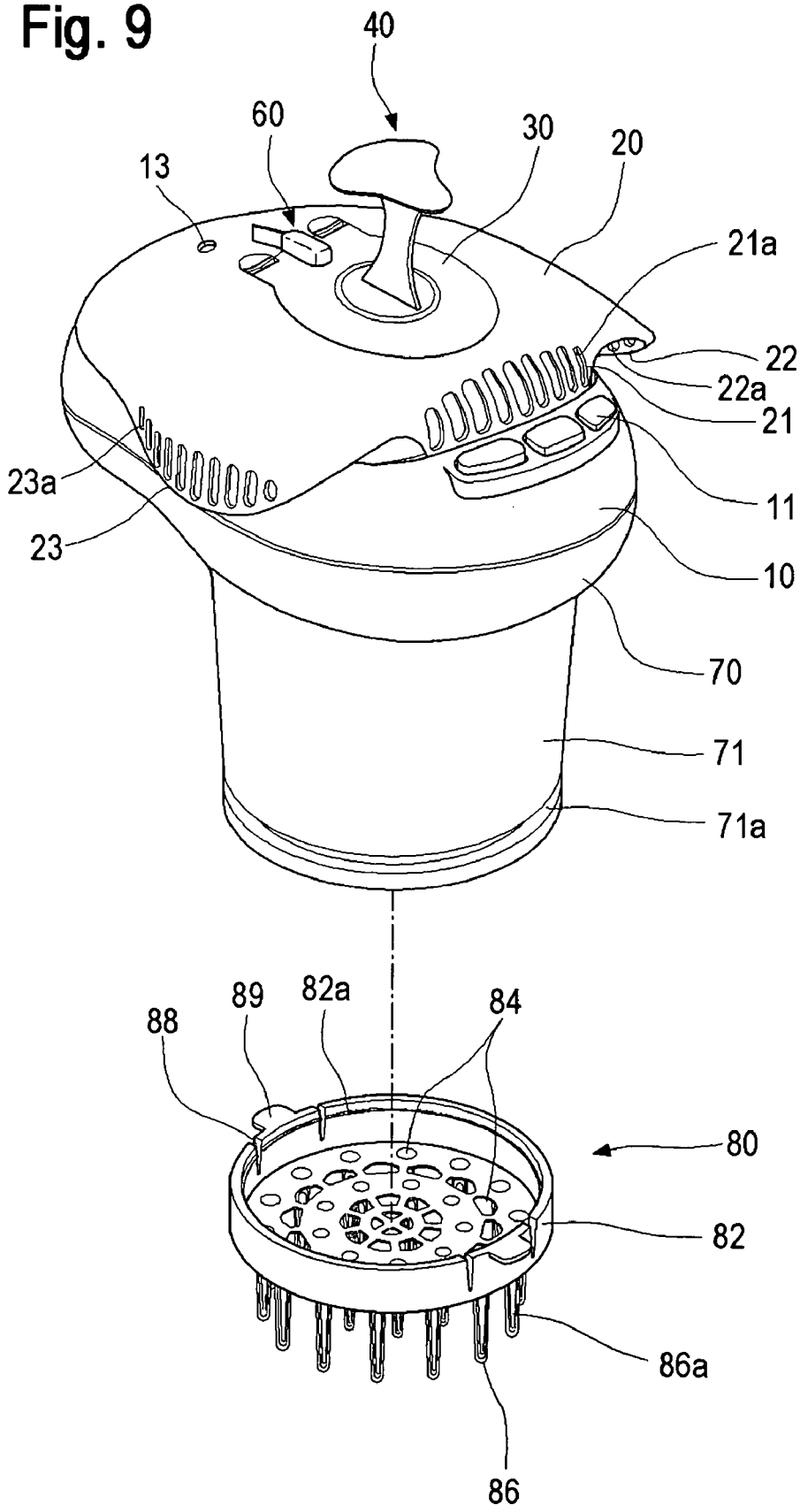
FIG. 9 is a partial exploded perspective view showing one embodiment of an auxiliary blowing unit.

FIG. 9 is a partial exploded perspective view showing an embodiment of an auxiliary blowing unit, which is detachably mounted to the blowing pipe 71. As shown in the drawing, an auxiliary blowing unit 80 includes: a cylindrical main body 82 having an opened top and a closed bottom; a plurality of air holes 84 distributed widely on the bottom of the main body 82; and a plurality of comb-teeth 86 extending downward from the lower surface of the main body 82. Each comb-tooth 86 is hollow and an air passage 86*a* is formed at the comb-tooth 86 by cutting a portion of the comb-tooth 86 longitudinally. The air passage 86*a* communicates with the air hole 84. Accordingly, the air and the far-infrared ray or anion exhausted out of the blowing pipe 71 and the auxiliary blowing unit 80 can be evenly spread to the hair and the scalp. Also, the hair drying and combing can be performed simultaneously by using the comb-teeth 86.

To couple the auxiliary blowing unit 80 to the blowing pipe 71, a groove 71*a* is formed around the outer circumference near the air outlet of the blowing pipe 71. Also, a protrusion 82*a* is formed corresponding to the groove 71*a* along the inner peripheral surface of the main body 82 of the auxiliary blowing unit 80. Two knobs 89 are formed at the side wall of the main body 82 and are opposite to each other. The knob 89 can be elastically deformed from the side wall of the main body 82 by slits 88 formed near the knob 89 at the side wall. The slits 88 enable the side wall of the main body 82 to be expanded partially when coupling or separating the auxiliary blowing unit 80 to or from the blowing pipe 71. Also, the knobs 89 facilitate the separation of the auxiliary blowing unit 80 from the blowing pipe 71.

Figure 10:
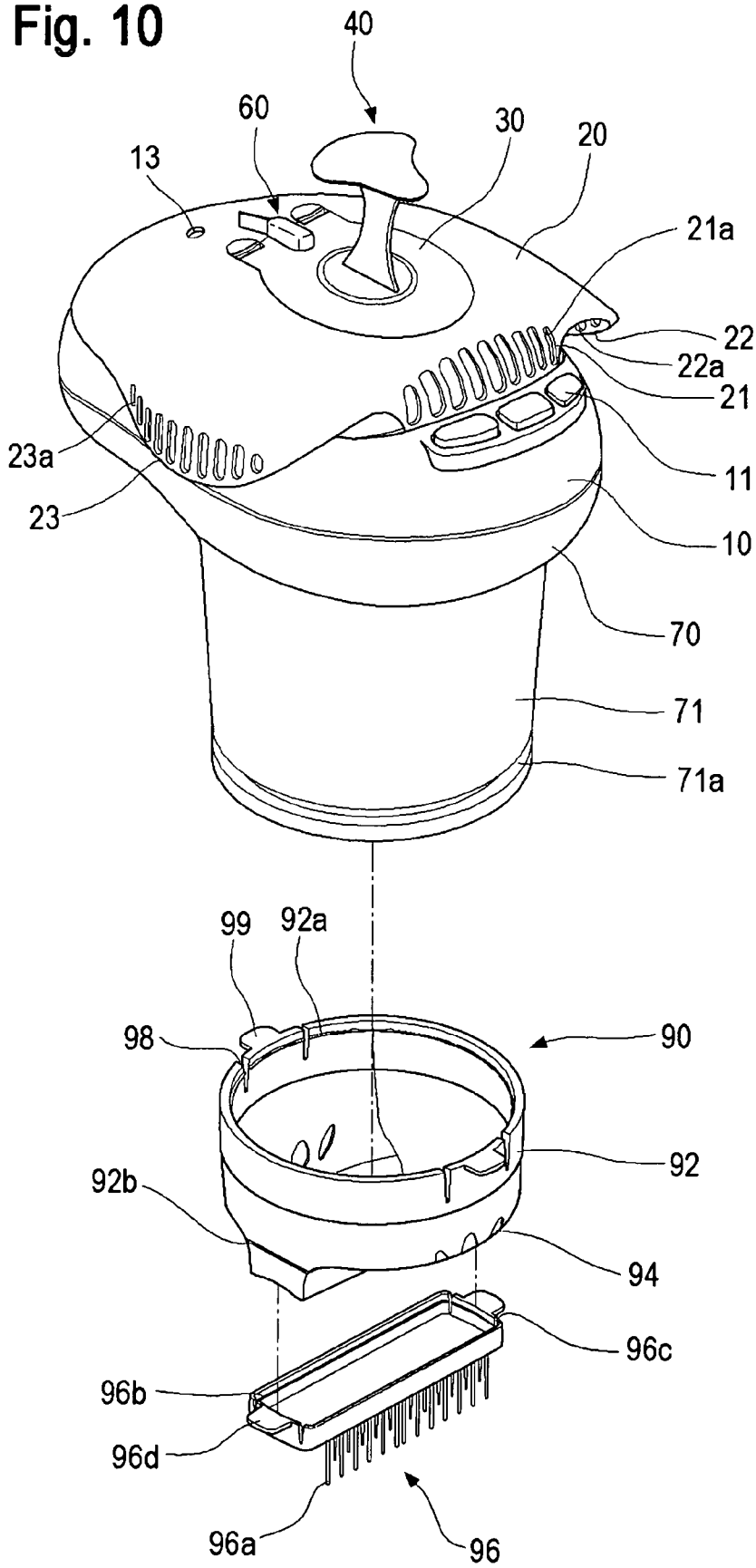
FIG. 10 is a partial exploded perspective view showing another embodiment of an auxiliary blowing unit.

FIG. 10 is a partial exploded perspective view showing another embodiment of an auxiliary blowing unit. As shown in the drawing, an auxiliary blowing unit 90 includes a main body 92 having an opened top with a circular cross-section and an opened bottom with a rectangular cross-section. The main body 92 becomes narrower as it goes from the top to the bottom. A plurality of air holes 94 is formed in a concentrated manner at the side wall of the main body 92. Such a structure is useful when concentrating the air on a certain region of the hair or the scalp.

To couple the auxiliary blowing unit 90 to the blowing pipe 71, a protrusion 92*a* is formed, which corresponds to the groove 71*a*, along the inner peripheral surface of the main body 92 of the auxiliary blowing unit 90. Two knobs 99 are formed at the side wall of the main body 92, which are opposite to each other. The knob 99 can be elastically deformed from the side wall of the main body 92 by slits 98 formed near the knob 99 at the side wall. The slits 98 enable the side wall of the main body 92 to be expanded partially when coupling or separating the auxiliary blowing unit 90 to or from the blowing pipe 71. Also, the knobs 99 facilitate the separation of the auxiliary blowing unit 90 from the blowing pipe 71.

The auxiliary blowing unit 90 further includes a comb member 96. The comb member 96 has an opened top with a rectangular cross-section and a closed bottom. A plurality of comb-teeth 96*a* extends downward from the lower surface of the comb member 96. To couple the comb member 96 to the main body 92, a groove 92*b* is formed around the outer surface near the bottom of the main body 92. Further, a protrusion 96*b* is formed, which corresponds to the groove 92*b*, along the inner surface of the side wall of the comb member 96. Two knobs 96*d* are formed at the side wall of the comb member 96 and are opposite to each other. The knob 96*d* can be elastically deformed from the side wall of the comb member 96 by slits 96*c*, which are formed near the knob 96*d* at the side wall. The slits 96*c* enable the side wall of the comb member 96 to be expanded partially when coupling or separating the comb member 96 to or from the main body 92. Also, the knobs 96*d* facilitate the separation of the comb member 96 from the main body 92. The air and the far-infrared ray or anion exhausted through the air holes 94 of the main body 92 are concentrated on a certain region of the hair or the scalp. The hair drying and the combing can be performed simultaneously by using the comb-teeth 96*a*.

Figure 11:
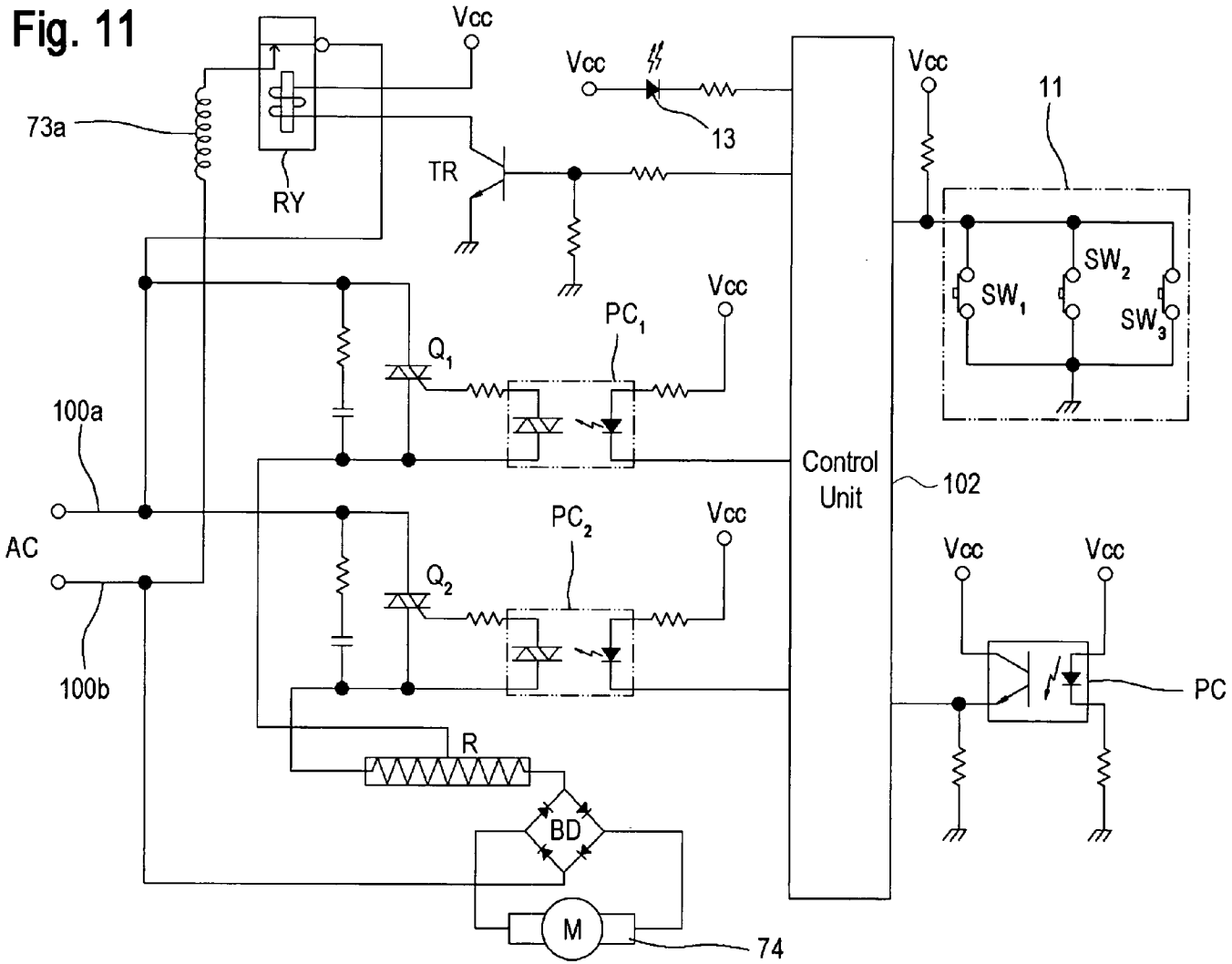
FIG. 11 is a control circuit diagram of a hair dryer constructed in accordance with the present invention.

FIG. 11 is a control circuit diagram of the hair dryer, which is constructed according to the present invention. As shown in the drawing, while AC power is supplied through power lines 100*a* and 100*b*, a control unit 102 checks if the photo coupler PC senses the movement of the power switch 60.

If the power switch 60 is pushed down and the photo coupler PC senses the movement of the power switch 60, the control unit 102 lights the lamp 13 to indicate the operating state. According to the operations of switches $SW_1$, $SW_2$ and $SW_3$ of the manipulating buttons 11, the control unit 102 determines whether to blow soft or strong wind and to generate heat or not. Then, it selectively operates the photo couplers $PC_1$ and $PC_2$ and a transistor TR.

For blowing soft wind, the control unit 102 operates the photo coupler $PC_2$ and a triac $Q_2$ interlocking with the photo couple $PC_2$. Then, AC power is supplied to the motor 74 at a low current via a resistance R and a bridge diode BD so that the motor 74 is driven at a low speed. On the contrary, if the control unit 102 operates the photo coupler $PC_1$ and a triac $Q_1$ interlocking with the photo coupler $PC_1$, AC power is supplied to the motor 74 at a high current via the resistance R and the bridge diode BD. This is so that the motor 74 is driven at a high speed, thereby blowing strong wind. To discharge heat with the soft or strong wind, the control unit 102 operates the transistor TR and a relay RY so that AC power is supplied to the heater 73*a* to generate heat.

Figure 12:
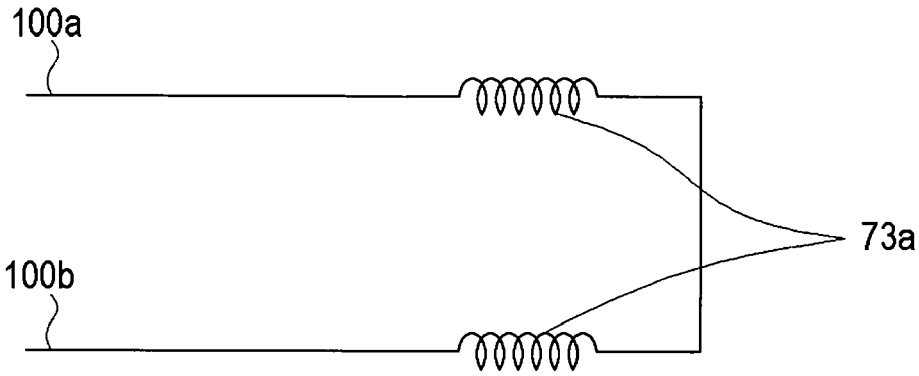
FIG. 12 is a drawing schematically illustrating a wiring of a heater coil.

As shown in FIG. 12, two power lines 100*a* and 100*b* for supplying power to the heater 73*a* and the motor 74 are arranged in parallel and apart from each other. Also, the directions of the electric current through the power lines 100*a* and 100*b* are opposite to each other so that a magnetic field is canceled around the power lines 100*a* and 100*b* due to the phase-inverse. Since such a magnetic field cancel effect is well known in the art, the explanation thereof is omitted herein. The gap of two power lines 100*a* and 100*b* is 3~7 mm (preferably, 5 mm). Also, the heater coils 73*a* are wired on both the power lines 100*a* and 100*b*. In the same manner, an electromagnetic wave is hardly generated around the heater coils 73*a* because of the phase-inverse. An experiment shows that the electromagnetic wave of only 10~40 mG is generated from the heater 73*a* of the hair dryer according to the present invention.

Figure 13:
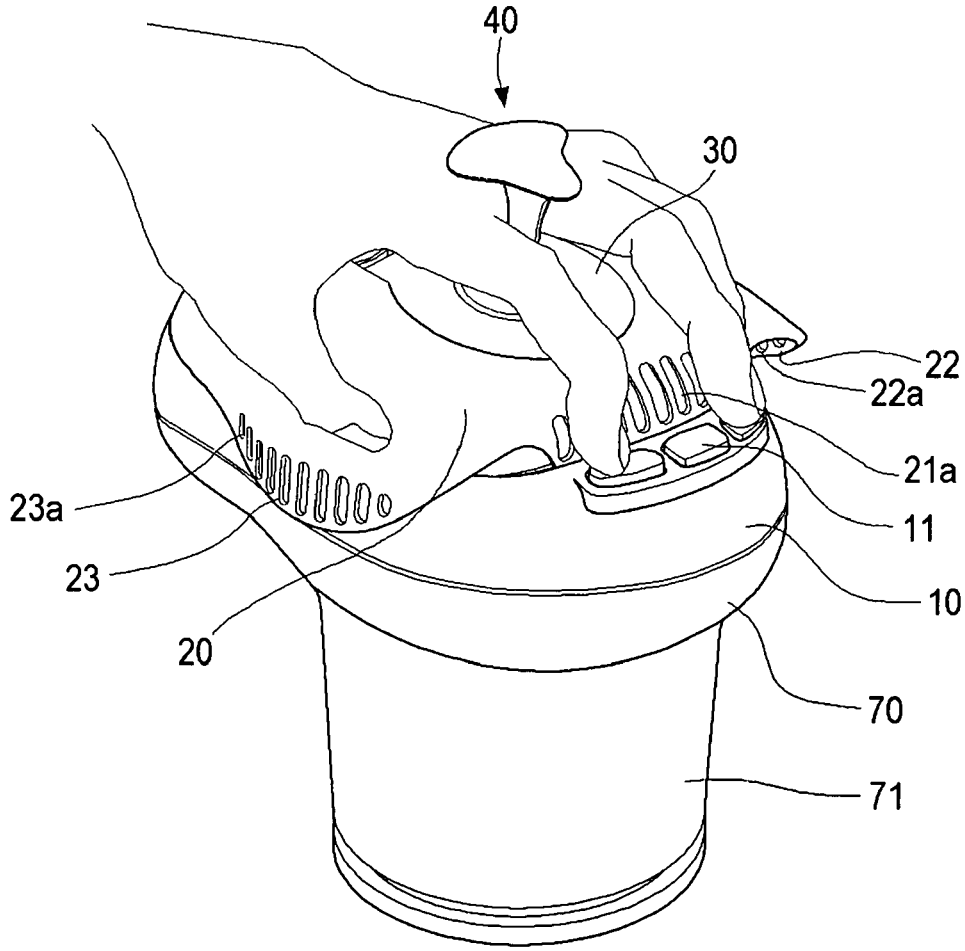
FIG. 13 is a perspective view illustrating an operating state of a hair dryer constructed in accordance with the present invention.

FIG. 13 is a perspective view showing an operating state of the hair dryer of the present invention. As shown in the drawing, if the user puts the handle 40 between his/her fingers and holds the grip part 20 in his/her palm, the power switch 60 (refer to FIG. 1) is pushed down due to the pressure of the palm holding the grip part 20 and the power is supplied to the hair dryer. While holding the grip part 20, if the user selectively pushes one of the manipulating buttons 11 with the ends of the finger, then soft or strong wind with/without heat is generated and blown out of the hair dryer, as explained above. When the user releases the grip part 20 from his/her palm, the power switch 60 is automatically turned off. Accordingly, although the manipulating buttons 11 are pushed down, the hair dryer does not operate.

As explained above in detail, the hair dryer according to the present invention is configured so that the direction of a palm of a user gripping the hair dryer is same as the direction of wind exhausted from the hair dryer. Accordingly, the direction of the wind can be easily changed with a small movement of the user's wrist. Thus, it is very convenient for the user to dry or style his/her own hair and the strain in the wrist can be minimized. Moreover, the user can freely rotate a handle in any direction so as to place the handle between the fingers in a convenient position according to his/her desire when drying or styling the hair.

Since the power switch is automatically turned off when the user releases the hair dryer from his/her palm, any unnecessary electricity consumption can be reduced and accidents such as electric shocks can be prevented.

By mounting an auxiliary blowing unit having a plurality of air holes and comb-teeth to a blowing pipe, the hair drying and combing can be performed simultaneously. In addition, soft or strong wind with/without heat, far-infrared ray and anion can be provided evenly or concentratedly on the hair or the scalp.

Also, the electromagnetic wave generated from a motor or a heater can be blocked from leaking so as not to inflict any damage to human body.

While the present invention has been described and illustrated with respect to a preferred embodiment of the invention, it will be apparent to those skilled in the art that variations and modifications are possible without deviating from the broad principles and teachings of the present invention which should be limited solely by the scope of the claims appended hereto.

What is claimed is:

1. A hair dryer, comprising:

a case;

a blowing pipe coupled to the case and having an air outlet at one end;

a heater for heating air disposed inside the case;

a fan for blowing air toward the heater and the air outlet, the fan being disposed inside the case;

a grip part configured to be gripped by a human hand, the grip part being coupled to a portion of the case opposite to the air outlet;

a handle mounted to the grip part so as to prevent the grip part from being released from the hand;

wherein a filter is mounted to a portion of the case facing the fan and a plurality of air intakes are formed at the grip part adjacent to the filter;

wherein a space is formed at the grip part above the filter for removing extraneous substances from the filter and a cover is detachably coupled to the grip part to open and close the space, the handle being installed on the cover;

wherein the handle includes a vertical plate configured to be fitted between two fingers of the hand, a horizontal upper plate formed at the top of the vertical plate to prevent the vertical plate from slipping out of the hand, and a horizontal lower plate formed at the bottom of the vertical plate; and wherein a depressed portion formed at the cover in which the lower plate of the handle is rotatably seated.

2. The hair dryer as recited in claim 1, wherein a cylindrical holder is located below the cover and connected to the lower plate of the handle so as to be rotated together with the handle, the holder having at least one supporting plate sectioned partially from the side wall of the holder to be deformed elastically from the side wall and a latching convex formed at the inner surface of the supporting plate, and wherein a circular loop is formed at the lower surface of the cover and surrounded by the holder, the loop having a plurality of recesses arranged radially along the overall outer periphery of the loop, wherein when the handle is rotated, the latching convex of the supporting plate is selectively fitted in one of the recesses of the loop.

3. The hair dryer as recited in claim 1, wherein a power switch for controlling the power supplied to the hair dryer and at least one manipulating button for selecting the operating mode are provided at the case, the power switch being pressed down by the pressure of the hand holding the grip part.

4. The hair dryer as recited in claim 3, wherein a switch-accommodating portion for accommodating the power switch is formed at the grip part, the power switch includes a push button exposed above the grip part, a spring for biasing the push button above the grip part, an operating rod extending from the push button toward the inside of the case, and a restraining rod extending from the push button toward the inside of the switch-accommodating portion, the restraining rod having a book at one end, and means for sensing the movement of the operating rod and a control unit for controlling the operation of the hair dryer in response to signals from the means for sensing the operating rod are provided inside the case.

5. The hair dryer as recited in claim 1, wherein a grill for blocking extraneous substances from entering into the blowing pipe is mounted at a position near the air outlet inside the blowing pipe, the grill being coated with ceramics containing tourmaline or iron oxide.

6. The hair dryer as recited in claim 1, wherein a far-infrared ray and anion generating device is mounted inside the case, the fair-infrared ray and anion generating device including a quartz tube coated with ceramics containing tourmaline or iron oxide a ceramic base provided in the quartz tube, and a heating coil wound around the ceramic base.

7. The hair dryer as recited in claim 1, wherein the hair dryer further comprises an auxiliary blowing unit detachably mounted to the blowing pipe near the air outlet, the auxiliary blowing unit having a plurality of air holes.

8. The hair dryer as recited in claim 7, wherein the auxiliary blowing unit includes a main body having an opened top and a closed bottom having the air holes, and a plurality of comb-teeth extending from the lower surface of the bottom of the main body, each comb-tooth being hollow and provided with an air passage communicating with the air hole by cutting a portion of the comb-toot longitudinally.

9. The hair dryer as recited in claim 7, wherein the auxiliary blowing unit includes a main body having an opened top and an opened bottom, the main body becoming narrower as it goes from the top to the bottom, and a comb member detachably mounted to the bottom of the main body and having a plurality of comb-teeth, and wherein the air holes are formed concentratedly at the side wall of the main body.

10. The hair dryer as recited in claim 9, wherein either a groove or a protrusion is formed around the outer surface near the bottom of the main body, and the other is formed along the inner surface of the side wall of the comb member, the protrusion being forcedly fitted in the groove, and wherein at least one knob is partially sectioned from the side wall of the comb member to be deformed elastically from the side wall.

11. The hair dryer as recited in claim 1, wherein two power lines for supplying the power to the hair dryer are provided in the case and arranged parallel apart from each other by 3~7 mm, the electric current passing through the power lines in an opposite direction to each other.

12. The hair dryer as recited in claim 11, wherein the heater includes coils and the coils are wired on both power lines.

* * * * *

UNITED STATES PATENT AND TRADEMARK OFFICE

CERTIFICATE OF CORRECTION

PATENT NO. : 7,428,785 B2
APPLICATION NO. : 11/244708
DATED : September 30, 2008
INVENTOR(S) : Tai Cheul Kim It is certified that error appears in the above-identified patent and that said Letters Patent is hereby corrected as shown below:

In column 2, line 39, please delete “book”, and insert therefor --hook--.

In column 2, line 65, please delete “comb-toot”, and insert therefor --comb-tooth--.

Signed and Sealed this

Seventh Day of April, 2009

JOHN DOLL
*Acting Director of the United States Patent and Trademark Office*